United States Patent [19]

Fischer

[11] 4,129,077

[45] Dec. 12, 1978

[54] DUAL FEED INKING SYSTEM FOR OFFSET PRINTING MACHINES

[75] Inventor: Hermann Fischer, Augsburg, Germany

[73] Assignee: Maschinenfabrik Augsburg-Nürnberg Aktiengesellschaft (M.A.N.), Augsburg, Germany

[21] Appl. No.: 872,891

[22] Filed: Jan. 27, 1978

[30] Foreign Application Priority Data

Jan. 28, 1977 [DE] Fed. Rep. of Germany ..... 2703424

[51] Int. Cl.[2] ..... B41L 27/16; B41F 31/14; B41F 31/30

[52] U.S. Cl. ..... 101/350; 101/DIG. 6

[58] Field of Search ..... 101/DIG. 6, 349, 350, 101/351, 352, 348, 206, 207, 208, 209, 357, 354–356

[56] References Cited

U.S. PATENT DOCUMENTS

| | | | |
|---|---|---|---|
| 2,467,199 | 4/1949 | Faeber | 101/DIG. 6 |
| 2,788,742 | 4/1957 | French | 101/351 |
| 3,301,182 | 1/1967 | Leviton | 101/351 |

*Primary Examiner*—J. Reed Fisher

*Attorney, Agent, or Firm*—Flynn & Frishauf

[57] ABSTRACT

To permit, selectively, either continuous application of printing ink to axially oscillating inking distribution rollers of an offset printing machine, or intermittent ink supply by means of a ductor roller, an ink supply roller 6 is driven at a speed matched to the speed of a printing cylinder 13, the ink roller 6 being in continuous contact with a next adjacent roller 8 of the ink train forming the inking system. Ink is supplied to the inking rolier 6, selectively, either by continuous contact with an ink ductor roller 3, which is then driven at a speed corresponding to the speed of the printing or plate cylinder; or, by changing the relative positions of some of the rollers of the ink train, for example by locating the bearing of an additional transport roller in a pivotal link, the additional transport roller can be moved intermittently by means of a cam or the like between the ductor roller 3 and the ink supply roller to intermittently transport ink from the ductor roller, engaged in an ink trough or well, to the ink supply roller. In the second position, with intermittent drive, the speed of the ductor roller can be less than the speed matched to that of the printing cylinder.

10 Claims, 3 Drawing Figures

DUAL FEED INKING SYSTEM FOR OFFSET PRINTING MACHINES

Figure 1:
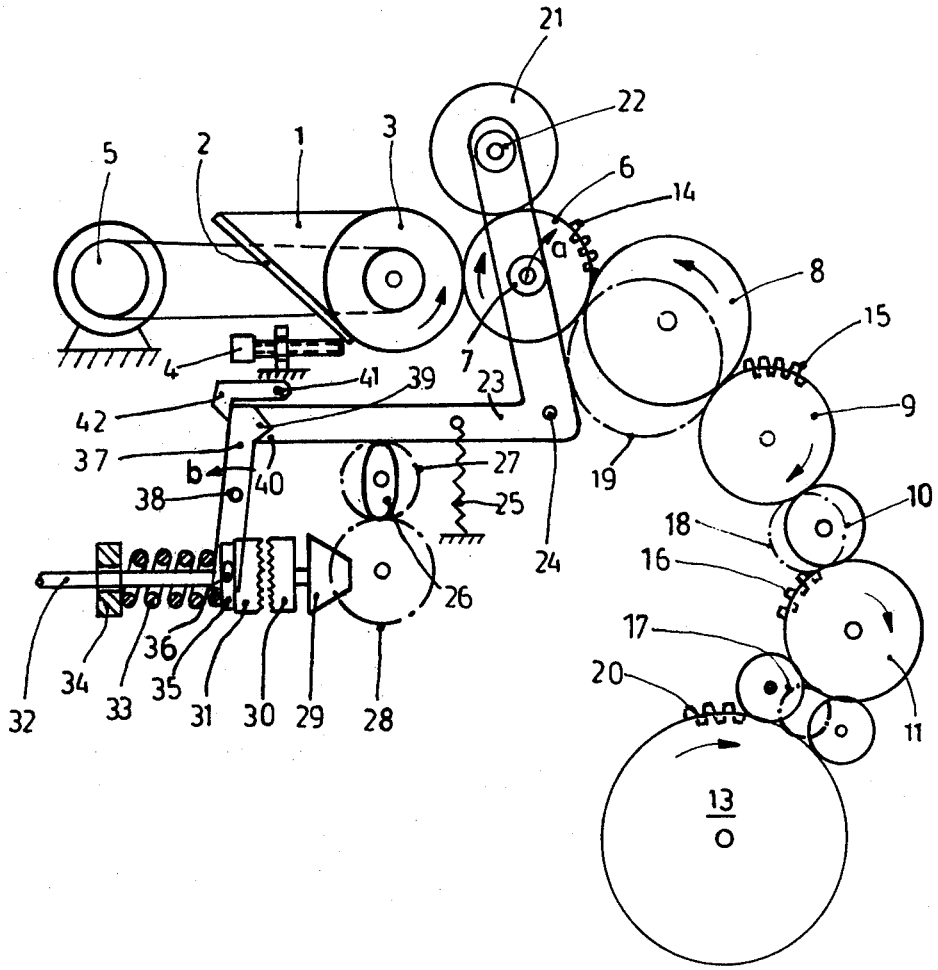

The present invention relates to an inking system for offset printing machines, and more particularly to an ink train arrangement in which an ink ductor roller picks up ink from an ink fountain, the ink ductor roller being driven independently, the ink from the ductor roller being selectively transferred to the ink train system either continuously or intermittently.

BACKGROUND AND PRIOR ART

Various types of inking systems for offset printing machines have been proposed; in one construction, for example, the main ink roller is in continuous contact with the ink ductor roller. Other types of inking systems are known, for example systems in which the main ink roller is in engagement with the ductor roller only intermittently. Such systems have been described, for example, in M.A.N.-Druck-maschinen-Nachrichten, Issue 62, pp. 3 to 18, particularly FIGS. 6 and 14.

Continuous ink film supply systems have the disadvantage that if the printed subject matter is comparatively small, or small formats of paper have to be worked with, or the width of the printing material is small, the wetting liquid, typically water, from the fountain system will spread over essentially the entire width of the fountain system rollers and also in the region of those edge zones which will not have printed subject matter appear thereon. An excess of water will then occur in the inking system itself. This excess of water, particularly in the edge regions, will lead to a water-ink emulsion in which the proportion of water is excessive. This results in toning and other undesirable printing results and, further, decreases the viscosity of the ink so that the excessively water-saturated water-ink emulsion may splash or spray off the edges of rotating equipment. This difficulty may also arise in sheet printing machines.

Intermittently inked ductor inking systems have the disadvantage that the intermittent contact of the ink roller with the ductor roller results, necessarily, in transmission of a comparatively thick strip or band of ink to the ink roller. It may be difficult to spread the strip of ink uniformly over the final inking roller in engagement wth the plate cylinder, and it is difficult to reliably and securely provide for uniform surface inking, particularly if larger single-colored ink surfaces are to be printed at comparatively high machine operating speed. To uniformly spread such a strip of ink, it is necessary to provide a plurality of axially oscillating spreader rollers which increases the construction expense of the system. The larger number of spreader rollers is required to spread the ink film in a uniform layer over the final inking roller in engagement with the plate cylinder, for example. Many oscillating or other spreader rollers additionally interfere with flexibility of the apparatus since the reaction of the ink supply through the ink train to changes in the ink supply rate is slow.

THE INVENTION

It is an object to provide an inking system for offset printing machines in which the printer can more easily and adequately match the ink being supplied to the subject matter being printed, and in which the disadvantages of known inking systems can be avoided with a minimum of constructional complexity.

Briefly, an ink acceptance roller is driven with a speed matched to that of the plate cylinder and, selectively, positionable in either of two positions. In one position, it is in continuous contact with an ink ductor roller as well as with an adjacent ink transfer roller. In this position, the ink ductor roller is driven at essentially the speed of the plate cylinder. In another position, however, which is obtained for example by means of a pivoting arm, contact of the ink supply roller is only with an additional ink train roller which is intermittently in contact with the ductor roller, for example by changing the position of the pivoting arm by means of a cam. The speed of the ink ductor roller then can be less than printing cylinder speed.

The printer thus can select the type of ink supply to the printing cylinder in accordance with subject matter to be printed and format thereof to obtain optimum printed results.

Figure 2:
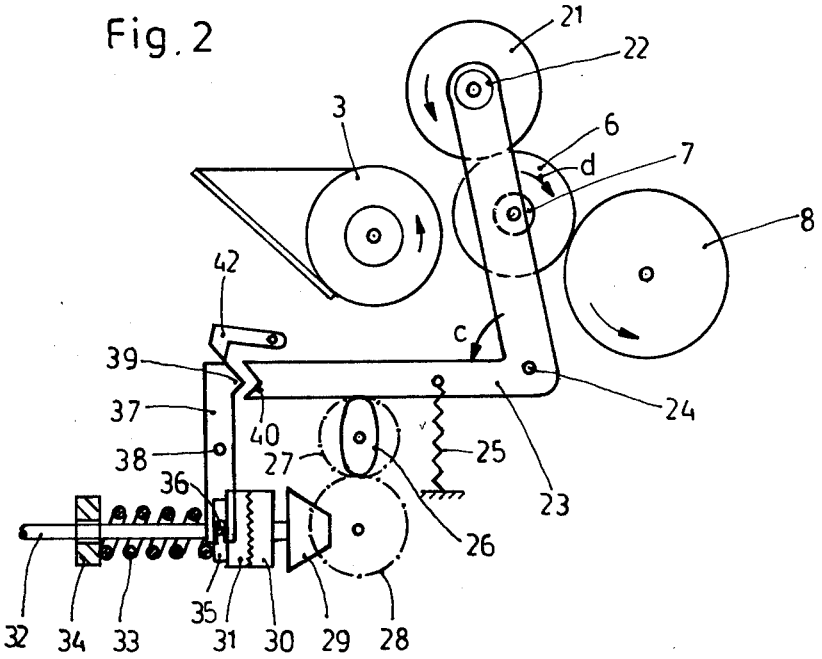
Figure 3:
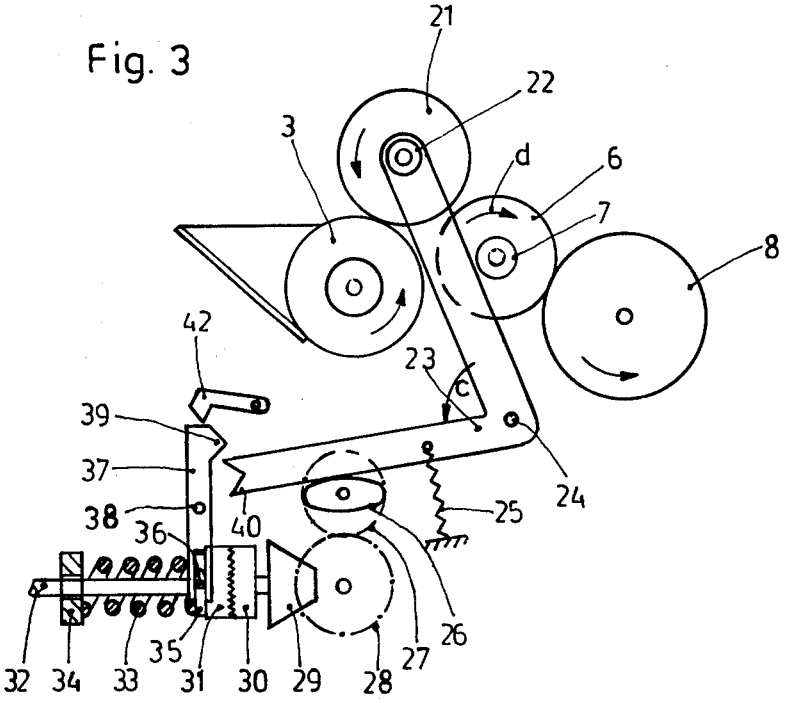

Drawings, illustrating a preferred example:

FIG. 1 is a highly schematic side view of the inking system for a rotary offset printing machine, and illustrating positioning of the system for continuous ink supply; and FIGS. 2 and 3 are fragmentary schematic side views of the system of FIG. 1, showing the placement of rollers for intermittent ink supply, in two different working positions.

The ink train has an ink trough or ink well 1 in which a ductor roller 3 is rotatably secured. The edge of a doctor blade 2 engages the circumference of the ductor roller. The ductor roller 3 has a metallic, ink-accepting surface. The gap between the ductor roller 3 and the doctor blade 2 can be adjusted by means of adjustment screws 4. A separate motor 5 is provided to drive the ductor roller 3 at a speed which is adjustable, for example by providing an adjustable speed drive motor, or a variable speed transmission between the motor 5 and the ductor roller 3.

A main ink supply roller 6 is in engagement with the ductor roller 3. Main supply roller 6 has a metallic, ink-accepting surface. The main ink supply roller 6 is secured in bearings 7 set in the side walls of the machine. The center position of the bearings is adjustable, for example by a double eccentric. The main ink supply roller 6 is in continuous ink transferring engagement with an ink train roller 8. The ink train roller 8 has an elastic surface, for example hard rubber, and is secured in the side wall of the printing machine (not shown), by suitable bearings (not shown) which are, preferably, likewise adjustable so that the center of the shaft of roller 8 can be adjusted. The ink transfer roller 8 is in surface engagement with a plurality of ink train rollers 9, 10, 11. The ink train rollers 9 and 11 are constructed to be axially oscillating to provide for surface distribution of ink being transferred thereto. Rollers 9, 11 have a metallic surface. The rollers 6, 9 and 11 have their shafts connected to pinions 14, 15, 16, shown only schematically. These gears 14, 15, 16 are connected to other pinions 17, 18, 19 which, in turn, are connected to a gear 20 which rotates together with the plate cylinder 13 of the offset printing machine. Thus, the rollers 6, 9, 11 are driven in synchronism with the plate cylinder 20. The main ink supply roller 6, as well as the ink train rollers 9, 11, operate at the same surface speed as the plate cylinder 13.

An ink transport roller 21 is journalled by means of adjustable bearings 22, one at each end of the shaft of roller 21, in a pivot lever 23. The pivot lever 23 is pivotably secured in bearing pins 24 extending to the side walls of the machine (not shown). At least one of the two levers 23 is maintained in an engagement with a cam 26 by a tension spring 25. The cam 26 is secured to a pinion 27 which is in engagement with a further pinion 28. Pinion 28 is in engagement with a conical gear 29 which is secured to a coupling disk 30 of a claw coupling, the other coupling disk 31 of which being secured to a shaft 32 which is connected, in turn, to the main machine drive. The coupling disk 31 is biassed by a spring 33 which tends to move the coupling disk 31 to the right in FIG. 1, this is, into engagement with coupling disk 30. Spring 33 bears against a fixed collar 34 formed on or secured to the frame (not shown) of the printing machine. The other side of the spring 33 bears against a switching disk 35 which is loose about shaft 32. The disk 35 has two follower pins 36 located thereon, and placed diametrically 180° with respect to each other, surrounded by a semicircular switching fork connected to switching lever 37. The switching lever 37 is pivotable about a fixed axis 38, journalled in the frame (not shown) of the machine. The free end of switching lever 38 is formed with a locking projection 39 engaging in a corresponding locking recess 40 of the pivot lever 23. A catch 42, pivotable about a pivot axis 41 and secured in the machine frame, when placed in the position shown in FIG. 1, holds the switching lever 37 in the position of FIG. 1, with the projection 39 in engagement with the matching recess 40 of lever 23.

Operation, continuous ink supply, with reference to FIG. 1: The main ink supply roller 6 is in continous contact with the ductor roller 3 and with the ink transfer roller 8. Cam 26 is not driven since the clutch disks 30, 31 are disengaged, the lever 37 holding disk 31 against the tension of spring 33, and catch 42 retaining the position of both levers 23 and 37. The bearings 22 of the ink transport roller 21 are so adjusted that the transport roller 21 runs as an idler on the surface of the main ink supply roller 6. The bearings 7 for the main supply roller 6, fixed in the frame of the machine, are preferably double eccenter bearings but simple single eccenter bearings may also be used, held in an adjustable lever which is pivotable about the axis of rotation of the transfer roller 8, rather than in the frame of the machine. In the position shown in FIG. 1, the speed of drive motor 5 is so adjusted that the surface speed of the ductor roller 3 is matched to the surface speed of the main supply roller 6 in accordance with the ink distribution of the subject matter being printed.

This mode of operation is preferably used if the subject matter to be printed has comparatively extensive surfaces requiring printing, the full width of the rollers of the ink train being used, and formation of zones or strips of different printing intensity must be avoided at all cost.

Operation, with intermittent ink supply, with reference to FIGS. 2 and 3: The system can be selectively operated with intermittent ink supply by slightly moving the position of the bearing 7 in the direction of the arrow a as shown in FIG. 1. The roller 6 then will move in a circular orbit about the axis of the transfer roller 8. This releases contact of the main supply roller 6 from the ductor roller 3. The holding catch 42 is then raised, which permits expansion of spring 33 and engagement of the two clutch portions 30, 31. The claw clutch will engage and cam 26 can now be driven from shaft 32 which, in turn, is driven from the main drive of the machine, for example. Simultaneously with closing of clutch 30, 31, the holding projection 39 of lever 37 is released from the matching recess 40 of lever 23. Lever 23 is now pulled by spring 25 in continuous engagement with the cam 26. Upon rotation of cam 26, lever 23 will oscillate about the pivot axis 24 in the direction of the arrow C (FIG. 2), and return counter the direction of the arrow C. In one terminal position of lever 23 (see FIG. 2), transport roller 21 is in engagement with the main ink supply roller 6. Ink is transmitted from the transport roller 21 to the positively driven main ink supply roller 6 which rotates in the direction of the arrow d. Upon continued rotation of the cam 26, lever 23 will rotate in the direction of the arrow c until the lever 23 will reach the position shown in FIG. 3. In this position, transport roller 21 is in engagement with the ductor roller 3 to receive ink therefrom, the ink then being transmitted to the main ink supply roller when, upon continued rotation of cam 26, lever 23 has again reached the position shown in FIG. 2.

Operation of the ink train in accordance with FIGS. 2 and 3 thus provides for intermittent ink supply. The speed of drive motor 5 driving the ductor roller 3 is then so adjusted that the ductor roller operates at a lower speed which is substantially less than the speed of the plate cylinder 13.

The adjustable bearings 7 and 22, journalling, respectively, the main supply roller 6 and transport roller 21, provide for adjustment of the engagement and, respectively, gaps between the ductor roller 3, the transport roller 21, and the ink supply roller 6. If desired, a fixed stop can be provided engaging the lever 23 to limit the pivoting excursion thereof when it approaches the position shown in FIG. 3.

The arrangement of the various rollers of the ink train beyond the main supply roller 6 is not critical or forms an important aspect of the present invention. Thus, the system is applicable with various types of ink train arrangements using, for example, further and additional axially oscillating friction rollers. For most ordinary and routine printing machines, the arrangement with the rollers shown in FIG. 1 is sufficient, and thus, from an economic standpoint, preferred. Various changes and modifications can be made, by addition or subtraction of further ink distribution rollers or positions, which may or may not be axially oscillating in accordance with requirements and economics of the overall machine structure.

I claim:

1. Dual-mode inking system for offset printing machines having a ductor roller (3) with an ink accepting surface;

means (1, 2) applying ink to the ink accepting surface of the ductor roller;

an ink train including a plurality of ink transport and transfer rollers (8, 9, 10, 11) transporting and transferring ink to the plate cylinder (13) of the printing machine, and comprising, in accordance with the invention, means to selectively apply ink from the ductor roller (3) to the ink train in either (a) continuous mode, or (b) intermittent mode, including an ink supply roller (6);

an ink transport roller (21);

movable bearing means (7) journalling the ink supply roller (6) for ink transferring surface contact with at least one of the rollers (8) of the ink train and, selectively, (a) in continuous contact with said ductor roller (3) for operation in continuous inking mode, or (b) out-of-contact with said ductor roller (3) for operation in intermittent inking mode;

movable bearing holder means (23) and bearings (22) therein journalling the ink transport roller (21), said movable bearing holder means (23) moving the transport roller (22) for selective engagement with the ink supply roller (6) when in a first position (FIG. 2), or with the ductor roller (3) when in a second position (FIG. 3);

selectively engageable operating means (26-36) operably connectable to said movable bearing holder means (23) and moving said bearing holder means betweeen said first and second positions when said ink supply means is operable in intermittent mode (b);

and variable speed drive means (5) connected to the ductor roller (3) to drive the ductor roller, selectively, when (a) the ink supply means operate in continuous mode, at a speed at which the surface speed of the ductor roller (3) and the surface speed of the plate cylinder (13) are approximately matched; and (b) the ink supply means operate in intermittent mode, at a speed at which the surface speed of the ductor roller (3) is less than the surface speed of the plate cylinder (13).

2. Inking system according to claim 1, wherein the movable bearing holder means (23) comprises a lever;

and said operating means (26–36) includes a cam in engagement with said lever, said cam moving said lever (23) to move said transport roller (21), alternately, in engagement with the ink supply roller (6) and the ductor roller (3).

3. Inking system according to claim 1, wherein the movable bearing means (7) journalling the ink supply roller (6) comprise double eccentric bearings (7) permitting, alternately, positioning of the ink supply roller in selected positions in, or out of engagement with said at least one of the rollers (8) of the ink train, in dependence on the selected operating mode of the system.

4. Inking system according to claim 1, wherein the selectively engageable operating means (26–36) includes a selectively engageable clutch (30, 31).

5. Inking system according to claim 1, further including drive means (14–20) establishing a positive drive connection between the ink supply roller (6) and the plate cylinder (13) to drive the ink supply roller (6) at a circumferential surface speed approximately matched to that of the plate cylinder (13).

6. Inking system according to claim 1, wherein the ink supply roller (6) has an ink accepting metallic surface.

7. Inking system according to claim 1, wherein the ink transport roller (21) has an ink accepting elastic surface.

8. Inking system according to claim 1, wherein the bearings (22) and movable bearing holder means (23) retaining said ink transport roller (21) locate the ink transport roller (21) in continuous surface engagement with said ink supply roller (6) when said ink supply means are operating in continuous mode (a).

9. Inking system according to claim 8, wherein said ink transport roller (21) is operating as an idler roller and rotated by surface engagement with that one of the rollers with which it is in surface contact, as determined by the position of said movable bearing holder means (23).

10. Inking system according to claim 1, further comprising interengaging interlock means (39, 40) operable on said movable bearing holder means and locking said movable bearing holder means in said first position when said ink supply means is operating in the continuous mode and disengaging said selectively engageable operating means (26–36).

* * * * *